US009637928B2

(12) United States Patent
Liptak et al.

(10) Patent No.: US 9,637,928 B2
(45) Date of Patent: May 2, 2017

(54) DRAIN SEAL

(71) Applicant: Handy & Harman, White Plains, NY (US)

(72) Inventors: Andrew J. Liptak, Westfield, MA (US); Peter J. Shadwell, Longmeadow, MA (US)

(73) Assignee: Handy & Harman, White Plains, NY (US)

( * ) Notice: Subject to any disclaimer, the term of this patent is extended or adjusted under 35 U.S.C. 154(b) by 148 days.

(21) Appl. No.: 14/188,719

(22) Filed: Feb. 25, 2014

(65) Prior Publication Data

US 2014/0265158 A1 Sep. 18, 2014

Related U.S. Application Data

(60) Provisional application No. 61/782,439, filed on Mar. 14, 2013.

(51) Int. Cl.
*E04B 5/48* (2006.01)
*E04D 13/04* (2006.01)

(52) U.S. Cl.
CPC .. *E04D 13/0409* (2013.01); *E04D 2013/0427* (2013.01)

(58) Field of Classification Search
CPC ..... F16L 21/02; F16L 21/03; F16L 17/025; E04D 2013/0427; E04D 2013/0436; B01D 35/02
See application file for complete search history.

(56) References Cited

U.S. PATENT DOCUMENTS 3,510,140 A * 5/1970 Hermann ..... F16L 21/025 277/604
3,893,919 A * 7/1975 Flegel ..... E04D 13/0409 210/166
4,799,713 A 1/1989 Uglow
5,141,633 A 8/1992 Walczak et al.
5,966,884 A 10/1999 Uglow
6,165,357 A * 12/2000 Cormier ..... E04D 13/0409 210/163
6,168,208 B1 * 1/2001 Thaler ..... E04D 13/0409 277/607
6,273,478 B1 * 8/2001 Benett ..... F15C 5/00 285/338
6,647,682 B2 * 11/2003 Bishop ..... E04D 13/0409 210/163
8,480,093 B2 * 7/2013 Skinner ..... F16L 21/005 277/616

(Continued)

*Primary Examiner* — Kristina Fulton
*Assistant Examiner* — Eugene G Byrd
(74) *Attorney, Agent, or Firm* — Alix, Yale & Ristas, LLP

(57) ABSTRACT

A sealing assembly for fluidly sealing a roof drain within a conductor pipe has a sealing element and an expansion ring. The sealing element defines an inner wall with a portion that transitions inward and may be disposed on a portion of the roof drain. The expansion ring is disposed within the inner wall. Reciprocation of the of the expansion ring along the inward transitioning portion of the inner wall causes the sealing element to expand outwardly to a sealed position with the sealing element outer wall abutting the conductor pipe inner wall in a fluid tight seal. Opposite reciprocation of the ring allows the sealing element to contract and release from the conductor pipe.

22 Claims, 9 Drawing Sheets

(56) References Cited

U.S. PATENT DOCUMENTS

| | | | | |
|---|---|---|---|---|
| 2009/0152866 | A1* | 6/2009 | Mutschlechner | F16L 21/03 285/377 |
| 2010/0264645 | A1* | 10/2010 | Jones | F16L 37/0925 285/105 |
| 2011/0278835 | A1* | 11/2011 | Kishi | F16L 17/032 285/18 |
| 2012/0187678 | A1* | 7/2012 | Williams | F16L 19/061 285/342 |
| 2012/0280497 | A1* | 11/2012 | Holmes, IV | F16L 21/03 285/379 |

* cited by examiner

DRAIN SEAL

CROSS-REFERENCE TO RELATED APPLICATIONS

This application claims the priority of U.S. Provisional Application No. 61/782,439, filed Mar. 14, 2013, the entire disclosure of which is incorporated herein by reference in its entirety.

FIELD OF THE INVENTION

The invention disclosed herein relates to a seal for retrofit roofing drains. More particularly, the invention relates to a seal for sealing the stem of a retrofit roofing drain inside a corresponding drain conductor that is easily removable and capable of reliably sealing with drain conductors having a range of diameters.

BACKGROUND

Existing retrofit roofing drain seals can be difficult to install and carry numerous drawbacks. Many known retrofit drain seals function internally to the retrofit drain stem. These seals normally require mechanical activation with specialty tools. Functioning internally to the retrofit drain stem dramatically reduces the cross sectional area of the stem and corresponding drain conductor, thereby reducing drain flow.

Other known retrofit drain seals function on the outer surface of the retrofit drain stem. These seals are forced into the corresponding drain conductor, the seal being wedged in the channel defined by the outer surface of the drain stem and the inner surface of the drain conductor. These known seals are often not mechanically activated and often lack adequate gap closure needed to create a sufficient seal between the drain stem and conductor. In either type of known seal, without a mechanical attachment to the retrofit drain stem, insufficient deactivation of the seal could and often does cause the seal to stick inside the conductor. On the other hand, if the seal is over-deactivated, it can easily fall into the conductor.

Permanently attached seals also exist in the field. In cases of permanent attachment to the drain stem, the seal is not removable or adjustable—rather fixed at a particular axial position along on the drain stem—therefore rendering adjustment of the drain stem length impossible. It would thus be useful to have versatile removable retrofit drain seal which requires no specialty tools and is mechanically activated for effective and reliable use with drain conductors of different sizes, is easy to install, reduces or eliminates installation errors, can be activated regardless of drain stem length, will stay secured to the drain stem during removal, and does not obstruct fluid flow down a drain.

DESCRIPTION OF THE PREFERRED EMBODIMENT

Figure 1:
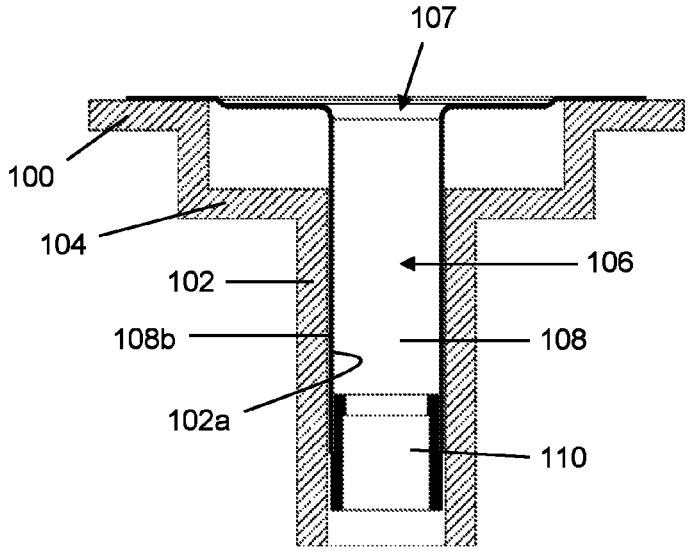
Figure 1 (Prior Art)
FIG. 1 generally shows a drain seal for use with roofing drain instrumentation as known in the prior art.

Embodiments of the disclosed inventive drain seal assembly 10 will be described with reference to a typical rooftop-drain bowl-drain conductor configuration depicted generally in FIG. 1. As shown, typically a rooftop 100 transitions to a drain conductor 102 via an intermediate drain bowl 104. A drain 106 with a drain stem 108 and a seal 110 slidingly engaged at or proximate its distal end is installed by inserting the drain stem 108 into and usually coaxial to the drain conductor 102. As shown, the seal 110 is made of a malleable material, such as rubber or a polymer, and is compressed between the conductor inner surface 102*a* and the pipe outer surface 108*b*, thereby creating a fluid tight seal there between.

The disclosed drain seal assembly 10 offers the following characteristics and properties:

- Mistake-free, simple installation
- Easily removable sealing element
- Versatile for common drain bowls, conductors and pipes of different configurations and sizes
- Allows trimming of drain stem, if warranted
- Minimal cross-sectional footprint (i.e., low flow restriction)

Figure 2:
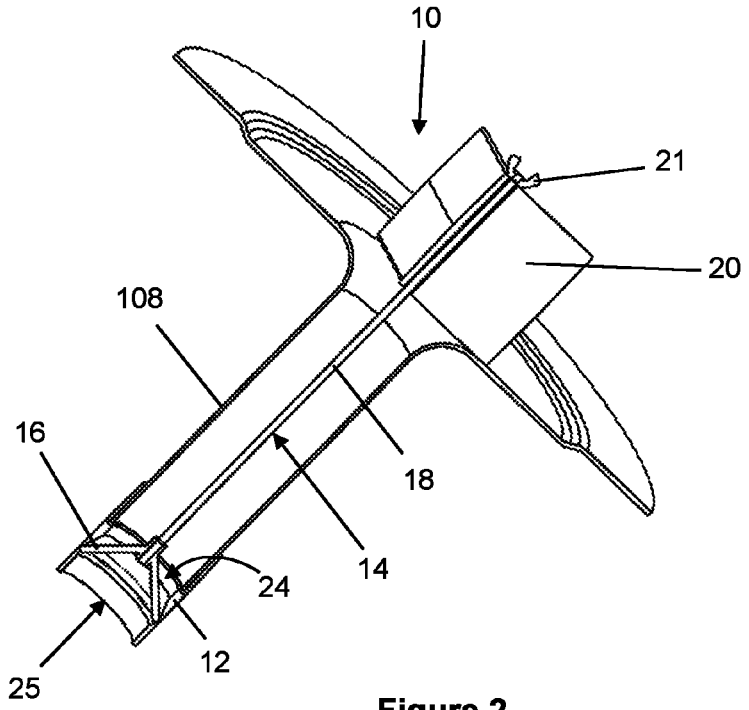
FIG. 2 is a section view of a drain seal assembly according to the disclosure engaged with a drain stem.

FIG. 2 shows a first embodiment of the disclosed drain seal assembly 10 comprising a sealing element 12 and an expansion unit 14. The expansion unit 14 comprises an expansion ring 16 engaged with an axially extending actuator 18 at the distal end of the actuator. The proximal end of the actuator 18 extends through a guide member 20 and is secured via a wing nut 21. The central bore 22 (shown in FIG. 4) extending through the guide member 20 is configured to maintain the actuator 18 in a substantially axial position when the assembly 10 is installed in a drain with the actuator 18 extending through the guide member bore 22.

Figure 3:
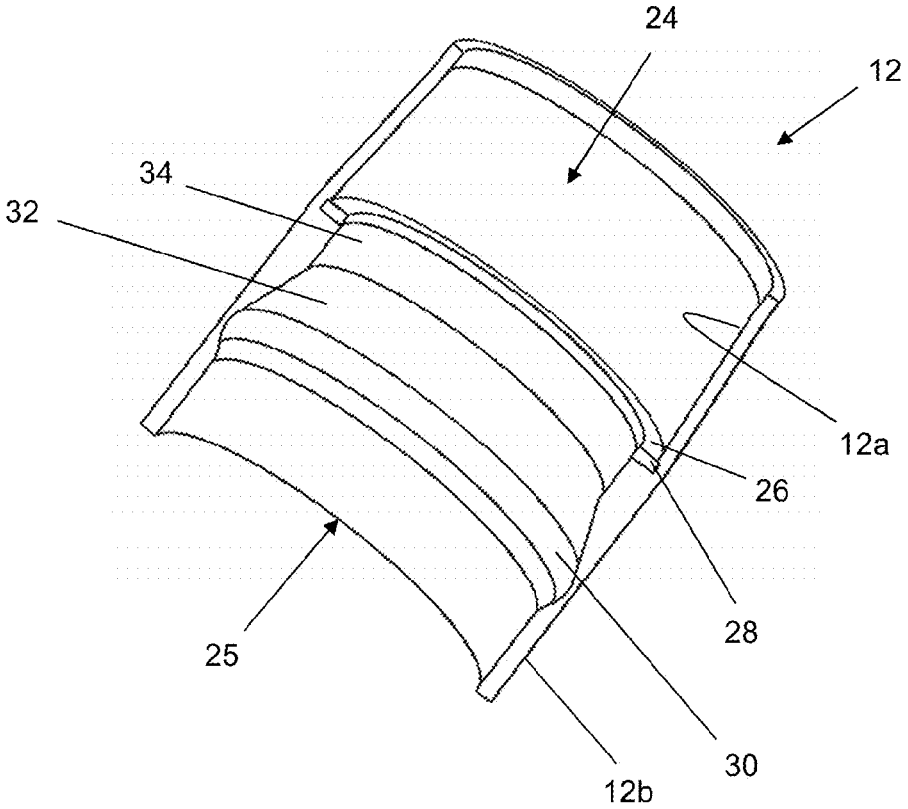
FIG. 3 is a section view of the sealing element of the disclosed drain seal assembly.

With reference to FIG. 3, the sealing element 12 defines a channel or passage 24 to an outlet 25 and includes an inner wall 12*a* and outer wall 12*b*. A radial shoulder 26 extends into the channel 24 intermediate the sealing element proximal end and the outlet 25. In the depicted embodiment, a substantially rigid support ring 28 is disposed within the channel and defines the upper surface of the radial shoulder 26. The support ring 28 adds stability to the sealing element which is often somewhat malleable material, as well as provides a clean, flat surface for a strong abutment with the distal end of the drain stem 108 when installed, thereby helping prevent deformation and slipping of the sealing element 12 on the drain stem 108. The sealing element 12 also includes a radial groove 30 in the inner wall 12*a* intermediate the shoulder 26 and the distal end (outlet 25). As shown, the inner wall 12*a* of the sealing element 12 transitions inward in the proximal direction intermediate the shoulder 26 and groove 30. Intermediate the inwardly tapered portion 32 and the radial shoulder 26 is a section 34 with a substantially uniform inner diameter (i.e., non-tapered portion) separating the tapered portion 32 from the shoulder 26.

Figure 4:
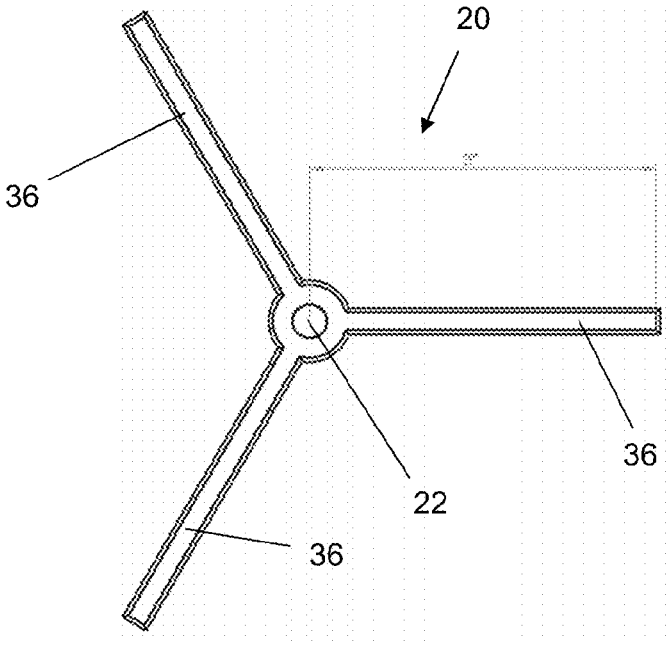
FIG. 4 is a top elevation view of the guide member of the disclosed drain seal assembly.
Figure 5:
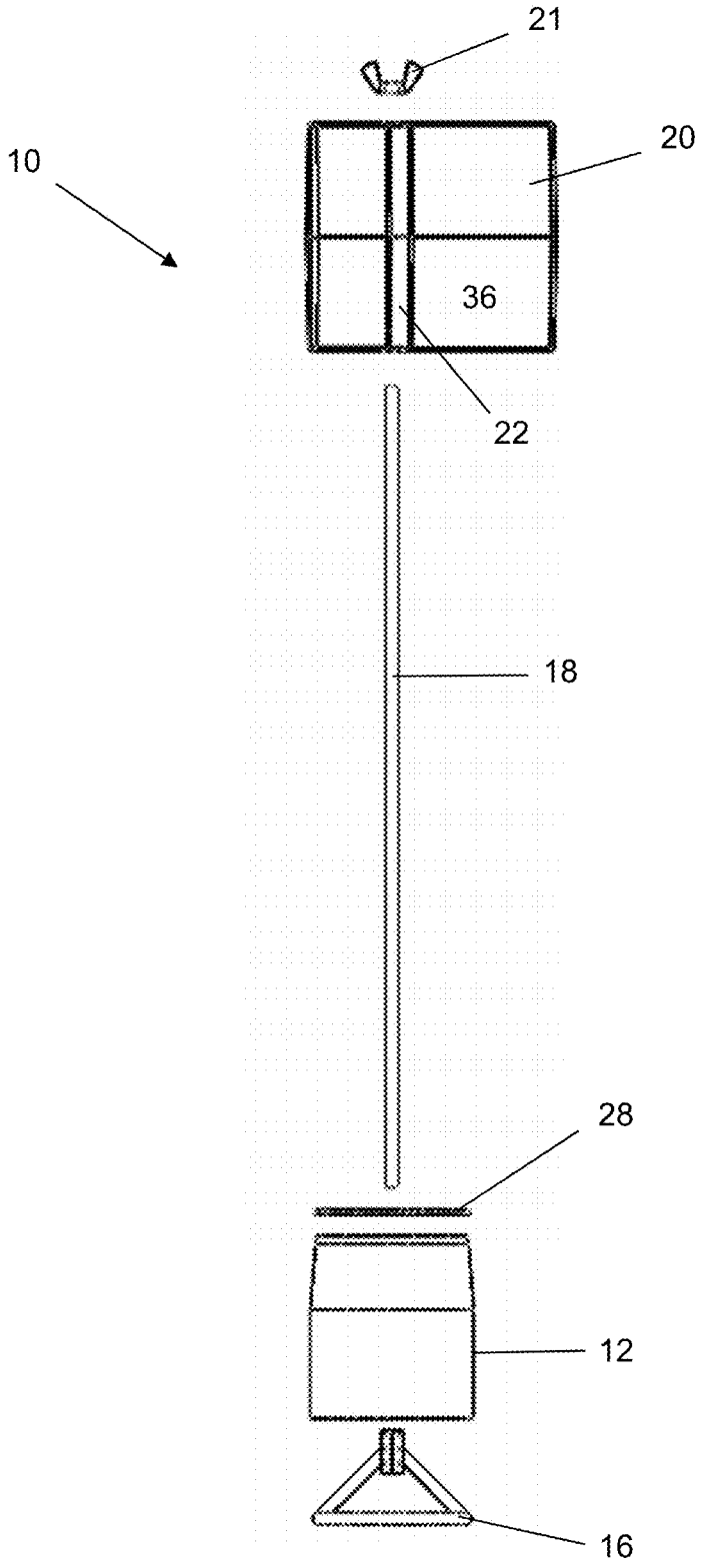
FIG. 5 is an exploded view of the disclosed drain seal assembly.

In the depicted embodiment, the guide member 20 includes a plurality of spaced fins 36 extending radially outward from the central bore 22. As shown in FIG. 4, the preferred embodiment includes fins that are equi-angularly-spaced around the 360° of the bore 22. Here, the guide member includes three fins 36 extending outward approximately 120° apart. However, the relative spacing between fins 36 may be varied to control desired flow properties at the drain inlet in different environments or with different drains. The depicted fins 36 have a relatively uniform thickness, however thickness may also be altered and may transition or taper along the length or height of the respective fins.

Figure 9:
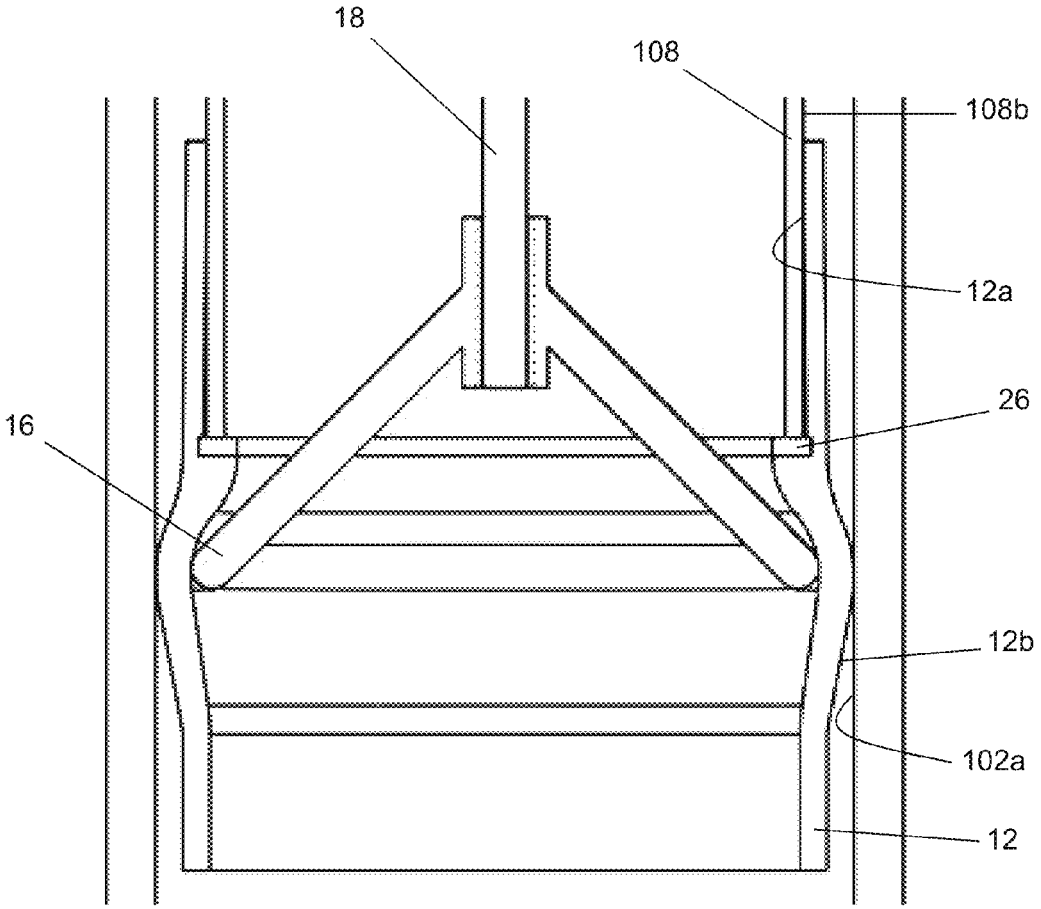
FIG. 9 is an enlarged view of the sealing element and expansion ring in the sealed position.
Figure 10:
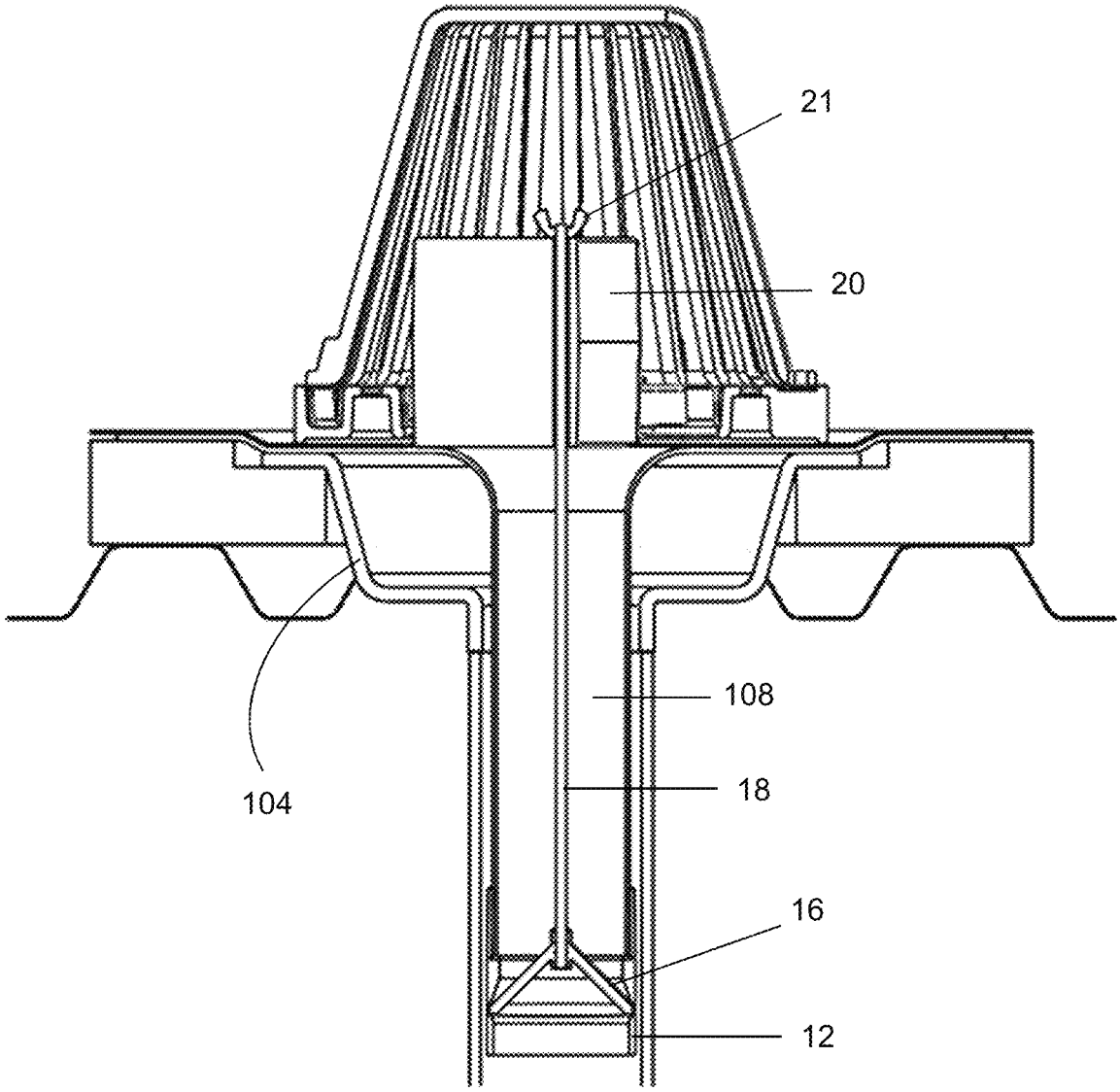
FIG. 10 is a section view of the drain seal assembly in a typical roof installation with the sealing element in the relaxed position.

With reference to FIG. 9, the proximal end of the sealing element 12 is shaped and configured to slidingly engage with the distal end of the drain stem 108 with the sealing element inner wall 12*a* tightly interfacing with the outer surface 108*b* of the drain stem 108. The radial shoulder 26 provides a positive stop against the front rim surface of the drain stem 108. As can be seen in FIG. 3, the sealing element may be slightly tapered inward toward its proximal end for assisting in creating a fluid-tight seal with the drain stem 108 when engaged.

As depicted in FIGS. 2, 6 and 8-11, when the sealing element 12 and drain stem are engaged, the expansion ring 28 is positioned axially proximal the shoulder 26 and the proximal end of the drain stem 108. The expansion ring 28 may be positioned within the channel 24 prior to sliding the sealing element 12 onto the drain stem 108 or may be slid into position in the groove 30 through the sealing element outlet 25 after the sealing element and drain stem are engaged.

As shown, the actuator 18 extends from the ring through the drain stem 108 and axially beyond the drain inlet 107. The actuator 18 and expansion ring 16 may be permanently attached, via welding, riveting or soldering for example, or may be removably attached via threaded engagement, clipping or the like. In the depicted preferred embodiment, the actuator 18 extends through the central bore of the guide member 20, which is sized and shaped to appropriately maintain the actuator. Here, the proximal end of the actuator 18 included outer threading (not shown in detail) for receipt of a wing nut 21. An alternative embodiment exists wherein the bore 22 is provided with threading to mate with outer threading on a portion of the actuator 18 and the actuator is optionally fit with a cross member for assisting in torqueing thereof.

Figure 6:
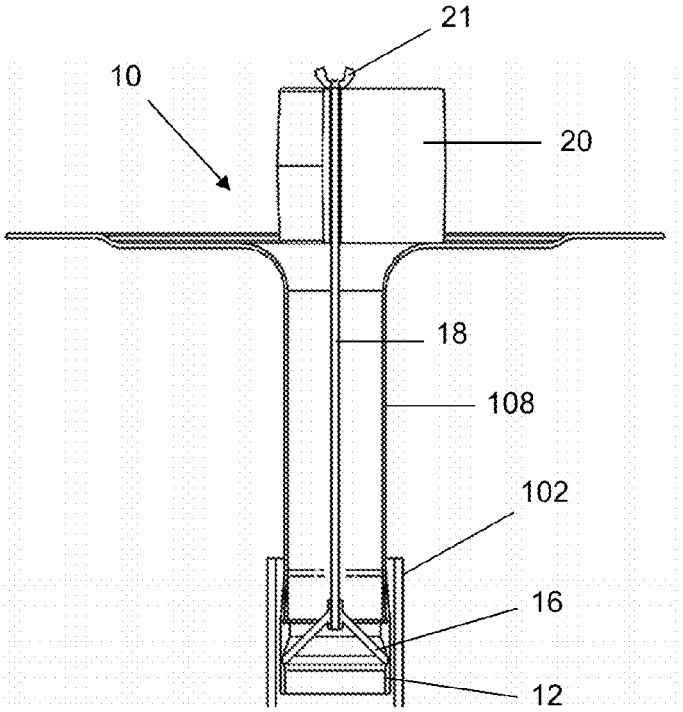
FIG. 6 is a section view of the drain seal assembly engaged with a drain stem being installed within a drain conductor.
Figure 7:
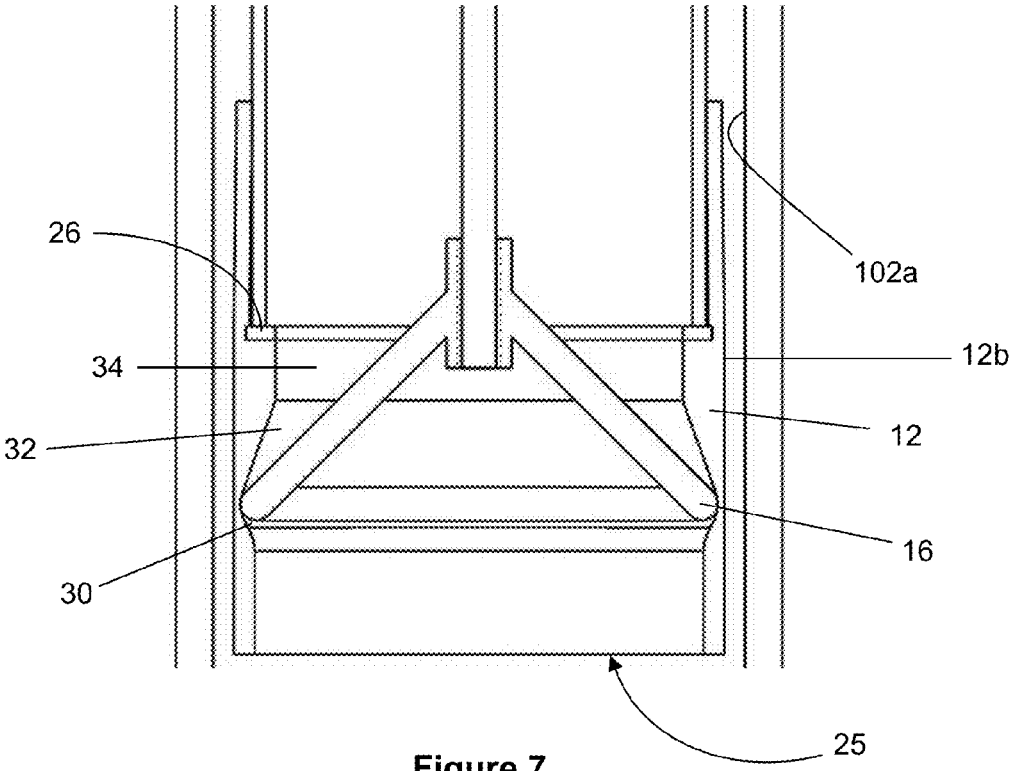
FIG. 7 is an enlarged section view of the sealing element and expansion ring in the relaxed position.
Figure 8:
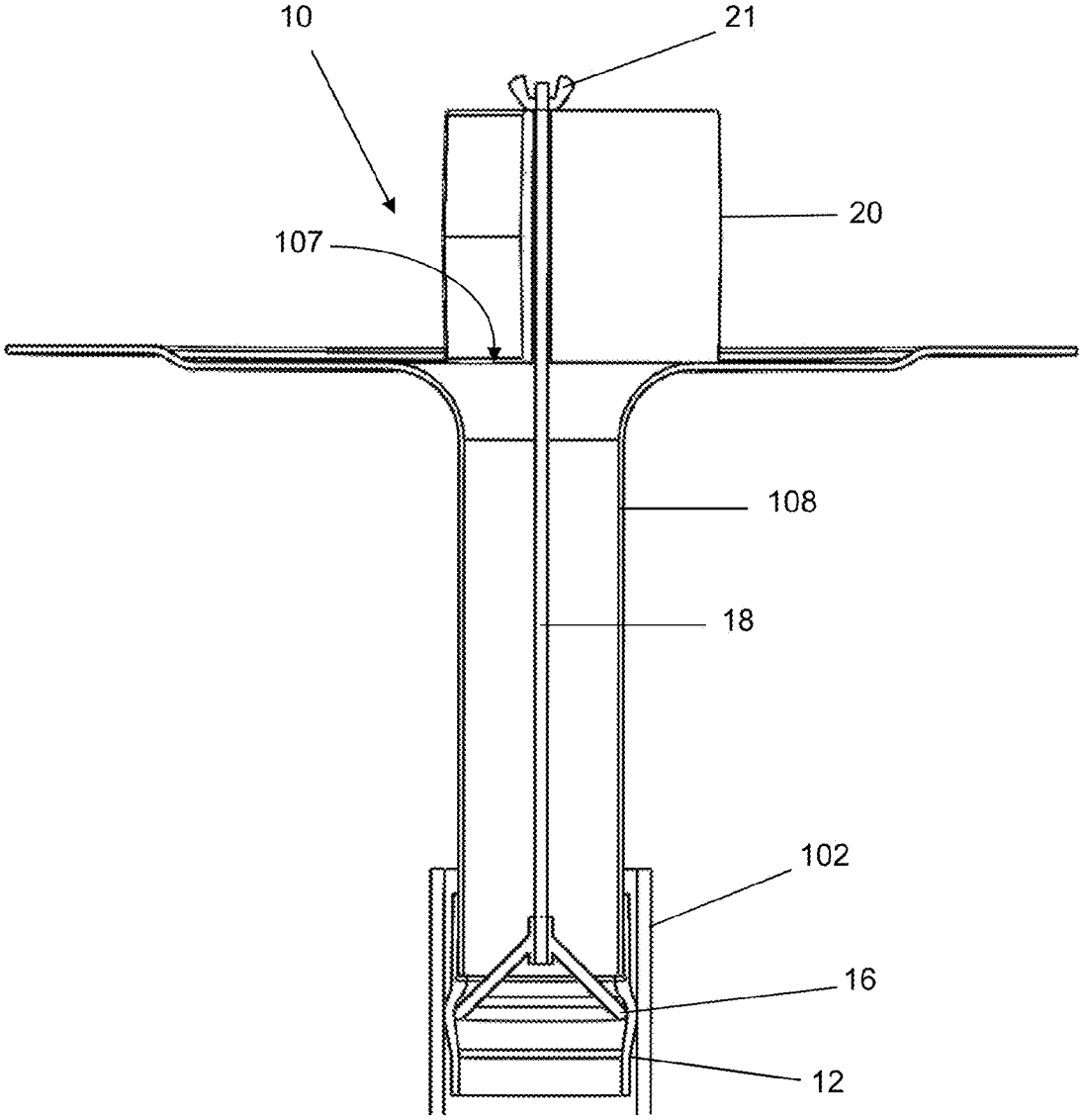
FIG. 8 is a section view of the drain seal assembly engaged with a drain stem and installed within a drain conductor in the expanded sealing position.
Figure 11:
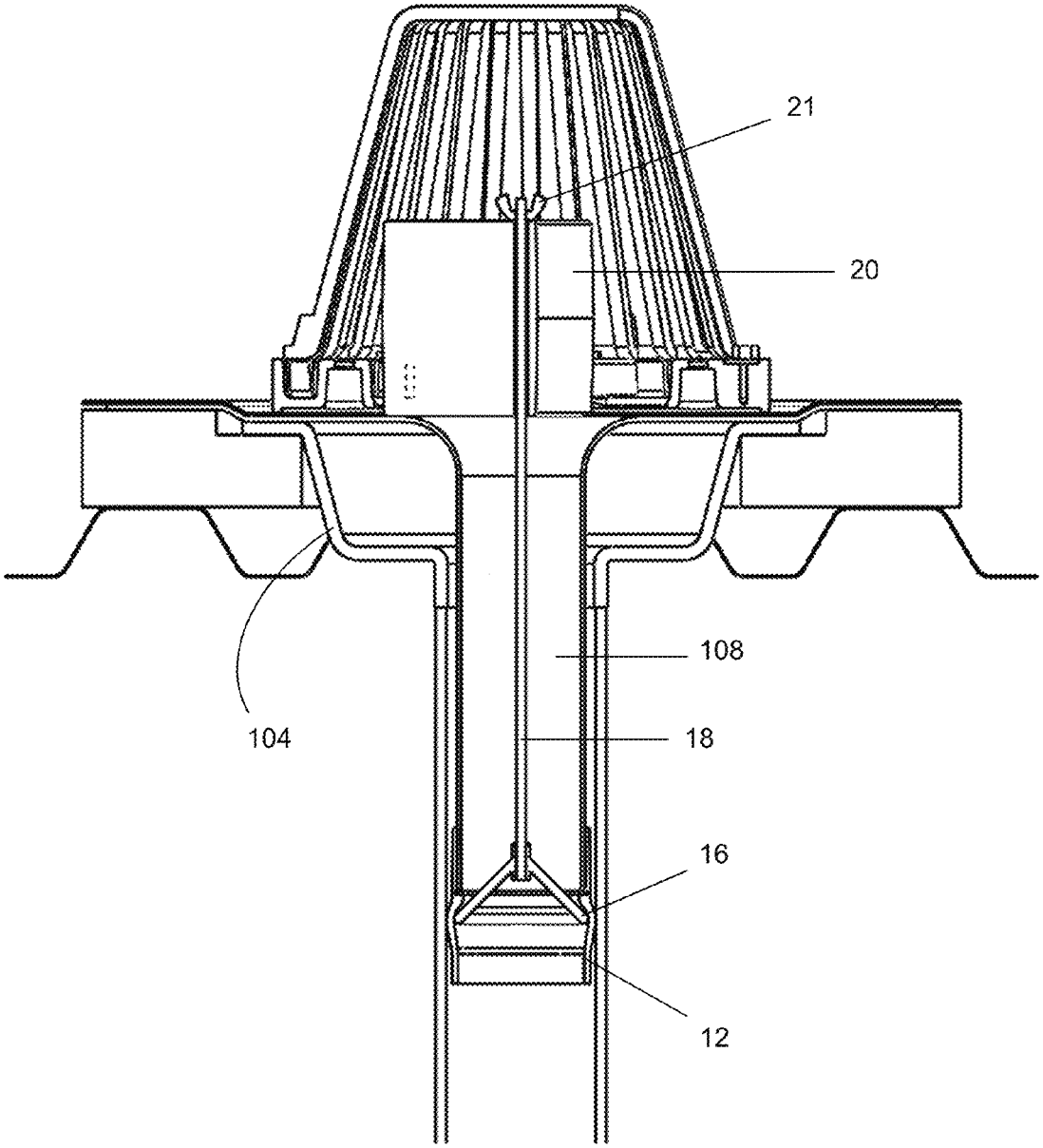
FIG. 11 shows the drain seal assembly installation of FIG. 10 with the sealing element in the expanded sealed position.

With reference to FIG. 8, the guide member 20 is shaped and sized to abut the drain bowl surface at the inlet 107. Once the drain seal assembly 10 is mechanically attached to the drain stem 108 (shown for example in FIG. 2), the drain stem may be easily slid into an existing drain conductor (shown for example in FIGS. 6 and 10), such as that depicted as reference numeral 102 in FIG. 1. While the expansion ring 28 is in a relaxed position within the groove 30 of the sealing element 12 as depicted in FIGS. 6 and 7, the assembly is allowed to slide cleanly into the conductor pipe with little or no frictional resistance. Once the drain stem 108 is positioned appropriately within the conductor pipe 102 in the relaxed position, the threaded wing nut 22 may be tightened on the actuator 18, thereby causing reciprocation of the actuator and expansion ring 28 axially in the proximal direction (i.e., upwards in the depicted Figures). The expansion ring 28 travels axially along the inward taper 32 of the sealing element wall, thereby expanding the sealing element 12 outward into a sealed position with the outer wall 12*b* of the sealing element tightly interfacing the inner wall 102*a* of the conductor pipe, as shown in FIGS. 8, 9 and 11. The disclosed assembly 10 allows installation into conductor pipes of varying diameters simply by further tightening the wing nut 21, which reciprocates the expansion ring 28 further along the inward taper 32, thereby expanding the sealing element 12 further outward. The mechanical connection provided by the assembly provides a strong fluid tight seal between the drain stem and conductor without risk of distortion or relative sliding between the sealing element and drain stem.

Figure 12:
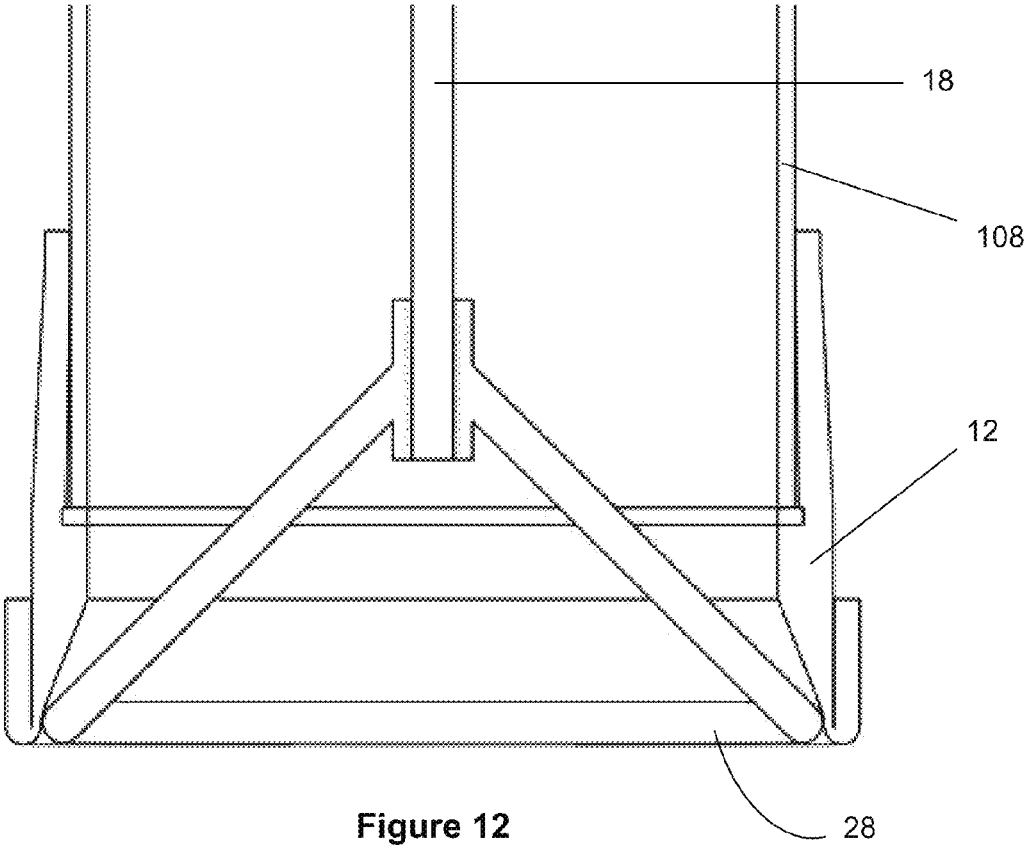
FIG. 12 shows the sealing element with distal end folded proximally for use within larger diameter drain conductors.

As shown in FIG. 12, the sealing element 12 may optionally be folded proximally to increase its cross sectional reach (i.e., outer diameter). Accordingly, the disclosed assembly 10 may be installed within wider drain conductors that would otherwise require replacement of at least the sealing element and ring with larger components. Installation of the system 10 in the "folded" position depicted in FIG. 12 is as described with reference to the previous Figures—via axial reciprocation of the expansion ring 28 to expand or contract the sealing element 12. Notably, the expansion ring 28 is in the relaxed position in FIG. 12.

Once installed and expanded to the sealed position, the disclosed assembly 10 also provides for improved fluid flow down the roof drain conductor 102. The depicted guide member 20 with plurality of fins 36 extending beyond the proximal end of the drain at the bowl and overlay surface has been shown to reduce or prevent formation of a vortex at the drain stem inlet 107. The configuration and cooperation of the depicted sealing element 12 and expansion ring 28 provides for substantially unimpeded flow through the drain stem through the outlet 25. The depicted expansion ring 28 has a smooth outer edge surface. Another preferred embodiment exists with a jogged outer edge to slightly increase frictional forces between the expansion ring and sealing element wall. This configuration has been shown to provide a reliable and strong seal, especially with larger sized sealing elements.

A preferred embodiment of the sealing element 12 is made of a urethane-based polymer that is manufactured by an over-molding process with an aluminum support ring 28 bonded thereto with a suitable durable adhesive. Another suitable rigid material, such as another metal or rigid plastic, may be substituted for aluminum.

An alternate embodiment exists wherein the expansion ring includes a central threaded bore configured to mate with outer threading at the distal end of the actuator. The actuator may include a cross member and be axially fixed at its proximal end. Expansion of the sealing element from the relaxed position to the sealed position may then be accomplished by rotation of the actuator, which causes the expansion ring to travel axially up the actuator threading into the tapered section of the sealing element.

The direction by which the expansion ring activates the seal by pushing outward is not limited to the depicted proximal (i.e., upward) manipulation. The relative configuration of the inner wall of the sealing element 12 can be reversed such that distal reciprocation activates the sealing element. Still a further embodiment exists wherein the ring and actuator are rigidly attached and the inner wall of the sealing element 12 transitions inward intermediate the outlet and groove. Expansion of the sealing element 12 is accomplished simply by forcing the actuator in the distal direction until the sealing element 12 expands to form a tight interface with the inner wall of the drain stem 108. The actuator may then be axially fixed in place by a pin or any other appropriate known means therefor.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A sealing assembly for fluidly sealing a roof drain insert having a tubular portion and an outlet end within a generally cylindrical conductor pipe having an inner diameter that is greater than the drain insert tubular portion outer diameter, comprising a sealing element with a wall having an outer surface and an inner surface defining an inner passage extending axially from an upper end to a lower end, a radial shoulder extending into the passage intermediate the upper end and lower end, a radial groove intermediate the radial shoulder and lower end; and an expansion ring configured to mate generally with the sealing element groove in a relaxed position and being reciprocable axially, wherein the inner surface of the sealing element wall includes a portion that transitions inwardly from the radial groove toward the radial shoulder such that reciprocation of the expansion ring axially from the groove toward the shoulder causes outward expansion of the wall to a sealed position against the conductor pipe.

2. The sealing assembly of claim 1, comprising an axially reciprocable actuator rigidly attached at its distal end to the expansion ring for reciprocating the ring.

3. The sealing assembly of claim 2, comprising a guide member positioned at the proximal end of the drain insert for maintaining the actuator in a substantially axial position.

4. The sealing assembly of claim 3, wherein the guide member includes a plurality of fins extending outward from a substantially central bore configured for receipt of the actuator.

5. The sealing assembly of claim 4, wherein the tubular portion of the roof drain insert transitions from a bowl having an upper surface at the tubular portion proximal end and the fins extend axially beyond the bowl upper surface.

6. The sealing assembly of claim 3, wherein the guide member comprises an upper end and lower end with a substantially axial bore extending therebetween, the actuator extends through the bore with a proximal end having a threaded outer surface extending at least partially past the guide member upper end, comprising a nut member mated with the threading on the actuator proximal end.

7. The sealing assembly of claim 6, wherein axial reciprocation of the actuator and thereby expansion ring is directed by torqueing of the nut member.

8. The sealing assembly of claim 1, wherein the sealing element comprises a rigid ring defining an upper surface of the radial shoulder.

9. The sealing assembly of claim 1, comprising a rigid actuator mated at its distal end to the expansion ring for reciprocating the ring.

10. The sealing assembly of claim 9, wherein the actuator distal end has a threaded outer surface that is mateable within a threaded bore in the expansion ring.

11. The sealing assembly of claim 10, wherein axial reciprocation of the expansion ring is directed by rotation of the actuator and resulting cooperation of the actuator threaded surface and threaded bore.

12. A sealing assembly for fluidly sealing a roof drain insert having a tubular portion extending from a proximal end to a distal end within a generally cylindrical conductor pipe having an inner diameter that is greater than the drain insert tubular portion outer diameter, comprising a sealing element defining an inner axial flow channel and an inner shoulder extending into the channel, the sealing element configured to slidingly engage at its proximal end with the tubular portion at the roof drain distal end with the tubular portion abutting the inner shoulder and a portion of the sealing element extending beyond the tubular portion, a portion of the channel beyond the tubular portion defining a portion that transitions inwardly into the flow channel;

an expansion unit having a ring disposed within and substantially coaxial to the sealing element channel in a position beyond the roof drain distal end, and an actuator extending axially from the ring in the proximal direction; wherein manipulation of the actuator causes axial reciprocation of the ring within the channel relative to the sealing element thereby expanding the sealing element outward to an expanded position abutting the conductor pipe as the ring travels along the inward transition of the flow channel when the sealing element is engaged with the drain tubular portion within a conductor pipe, and drainage fluid entering the tubular portion is allowed to flow through the portion of the flow channel extending beyond the tubular portion.

13. The sealing assembly of claim 12, wherein the shoulder extending into the axial channel is distal of the portion of the channel that transitions inwardly.

14. The sealing assembly of claim 13, wherein the axial channel transitions inward in the direction of distal-to-proximal.

15. The sealing assembly of claim 12, comprising a circumferential ridge in the channel shaped generally to receive and axially maintain the ring in a relaxed position.

16. The sealing assembly of claim 12, comprising a guide member for maintaining the actuator in a substantially axial position, the guide member positioned proximal to the ring.

17. The sealing assembly of claim 16, wherein the guide member comprises a plurality of fins extending radially outward from a central bore through which the actuator extends.

18. The sealing assembly of claim 12, wherein the channel defines a section of substantially uniform diameter intermediate the radial shoulder and portion that transitions inward.

19. A sealing assembly for fluidly sealing a roof drain insert having a tubular portion and an outlet end within a generally cylindrical conductor pipe having an inner diameter that is greater than the drain insert tubular portion outer diameter, comprising a sealing element with a wall defining an outer surface and an inner surface defining an inner passage extending axially from an upper end to a lower end, a radial shoulder extending into the passage intermediate the upper end and lower end providing an upper surface for abutting the outlet end of the tubular portion, a radial groove intermediate the radial shoulder and lower end; and an expansion ring configured to mate generally with the sealing element groove in a relaxed position and being reciprocable axially, wherein the inner surface of the sealing element wall transitions inwardly from the radial groove toward the radial shoulder such that reciprocation of the expansion ring axially from the groove toward the shoulder causes outward expansion of the wall to a sealed position against the conductor pipe.

20. The sealing assembly of claim 1, wherein the inner surface of the sealing element comprises a substantially cylindrical portion intermediate the radial shoulder and the portion that transitions inwardly.

21. The sealing assembly of claim 20, wherein the substantially cylindrical portion is coextensive with the radial shoulder.

22. The sealing assembly of claim 21, wherein the substantially cylindrical portion extends directly to the radial shoulder.

* * * * *